United States Patent [19]

Gage et al.

[11] Patent Number: 4,809,586

[45] Date of Patent: Mar. 7, 1989

[54] HYDRAULIC SYSTEM FOR A WORK VEHICLE

[75] Inventors: Douglas M. Gage; Stuart L. Neagle, both of Dubuque, Iowa

[73] Assignee: Deere & Company, Moline, Ill.

[21] Appl. No.: 96,574

[22] Filed: Sep. 11, 1987

[51] Int. Cl.[4] ..... F01B 25/02

[52] U.S. Cl. ..... 91/6; 91/461; 251/26; 414/685

[58] Field of Search ..... 417/287, 199 A, 4, 426; 60/428, 486, 403, 405; 91/6, 28, 461, 453; 251/26; 414/685, 699

[56] References Cited

U.S. PATENT DOCUMENTS

| | | | |
|---|---|---|---|
| 2,309,983 | 2/1943 | Riddle . | |
| 2,946,196 | 7/1960 | Myers | 60/573 |
| 3,099,289 | 7/1963 | Neilson et al. | 91/6 |
| 3,659,419 | 5/1972 | Ikeda . | |
| 3,785,157 | 10/1974 | Kittle et al. . | |
| 3,847,060 | 11/1974 | Jaminski et al. | 91/453 |
| 3,859,790 | 1/1975 | Bacquie et al. . | |
| 3,962,870 | 6/1976 | Lech . | |
| 4,120,478 | 10/1978 | Hasegawa | 251/26 X |
| 4,303,089 | 12/1981 | Gage et al. | 60/328 X |
| 4,354,797 | 10/1982 | Hirose et al. . | |
| 4,372,193 | 2/1983 | Hall | 91/461 X |
| 4,422,290 | 12/1983 | Huffman | 60/404 |
| 4,475,442 | 10/1984 | Breeden | 91/461 |
| 4,508,013 | 4/1985 | Barbagli | 414/699 X |
| 4,509,406 | 4/1985 | Melocik | 91/461 X |
| 4,526,085 | 7/1985 | Morizur et al. . | |
| 4,635,439 | 1/1987 | Wible . | |
| 4,730,543 | 3/1988 | Holmes | 91/461 X |

OTHER PUBLICATIONS

John Deere Company brochure on the 844 Loader, Jul. 1985.

John Deere Company brochure on the Loader Models 444D, 544D and 644D, Oct. 25, 1985.

*Primary Examiner*—Edward K. Look

[57] ABSTRACT

The present invention is directed to a hybrid hydraulic system for a work vehicle having both an open center hydraulic circuit and a close center hydraulic circuit. An internal combustion engine drives a fixed displacement pump and a variable displacement pump. The fixed displacement pump provides hydraulic fluid to the open center circuit which directs hydraulic fluid to a steering circuit and the working circuit through a priority valve. The variable displacement pump provides hydraulic fluid to the close center circuit which directs hydraulic fluid to a braking circuit and a pressure reduction circuit. The pressure reduction circuit directs hydraulic fluid to a pilot control system, a clutch cutoff and a differential lock out. Both pumps receive hydraulic fluid from a common sump and a common suction line. The braking circuit comprises two independent braking circuits. Each of the braking circuits include a manually shiftable regulating valve which is hydraulically balanced between its output and the output of the other regulating valve. In this way, the regulating valves are hydraulically interconnected for piloting each other. The pressure reduction system is provided with a first two position solenoid valve which is fluidically positioned between the variable displacement pump and a pressure reducing valve which directs hydraulic fluid to the pilot control system. A working actuator provides an alternate source of hydraulic fluid which is fluidically coupled to the pilot control system when the first solenoid valve is energized. The pressure reduction system houses the first solenoid valve, the pressure reduction valve, and second and third solenoid valves for directing hydraulic fluid to be differential lock out and clutch cutoff, respectively.

11 Claims, 4 Drawing Sheets

FIG. 1
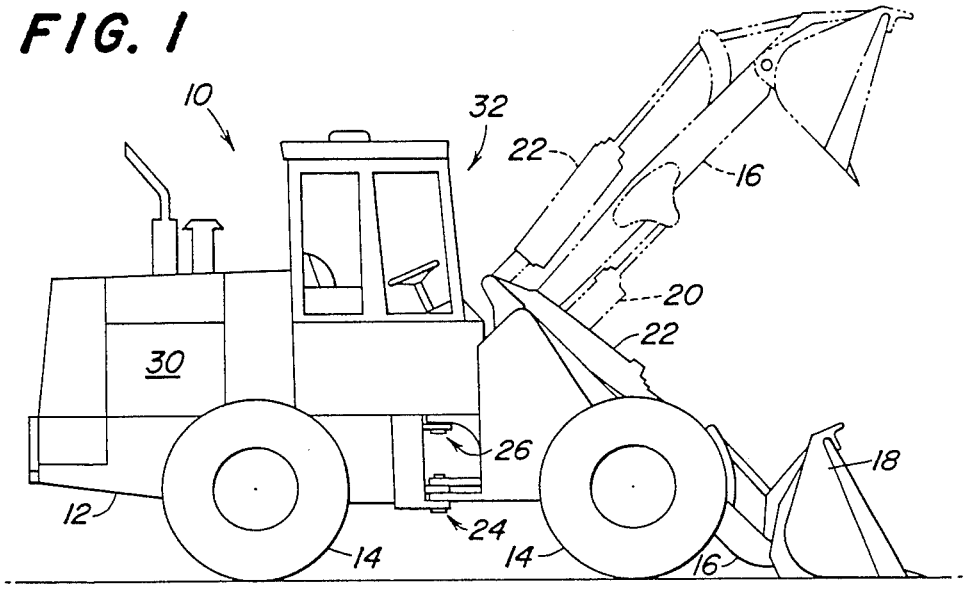
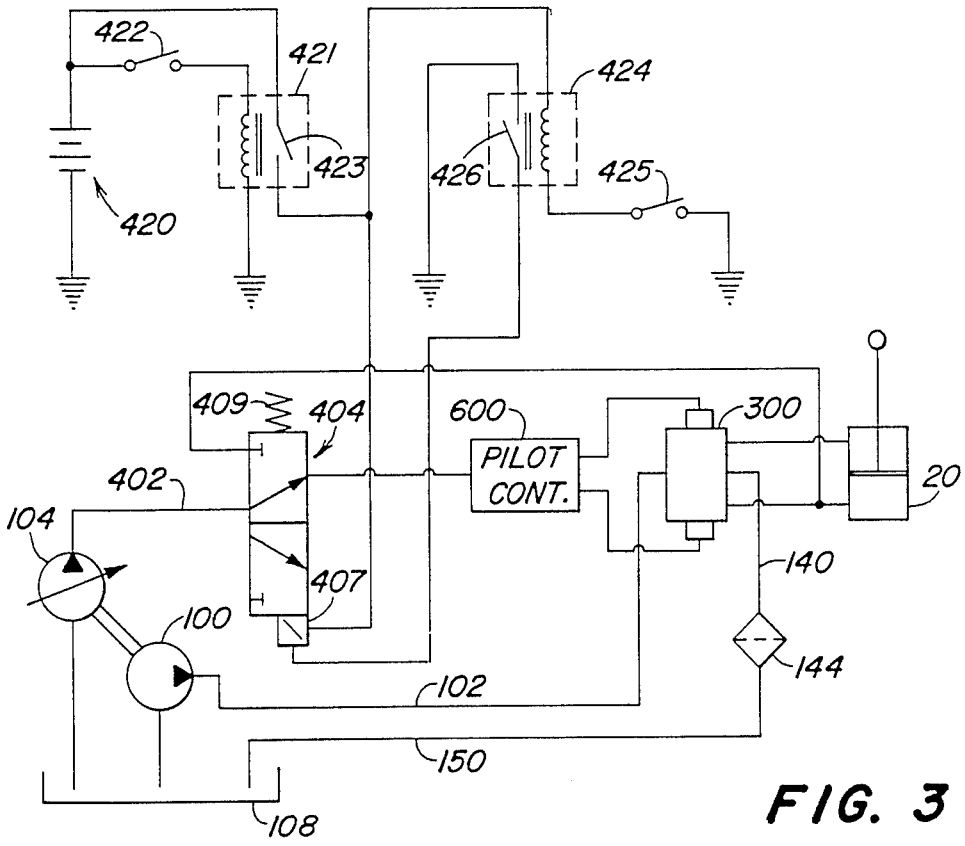
FIG. 3

HYDRAULIC SYSTEM FOR A WORK VEHICLE

BACKGROUND OF THE INVENTION

1. Field of the Invention

The invention is directed to a hybrid hydraulic system for a work vehicle. The hydraulic system comprises an open center for providing hydraulic fluid to high flow functions, and a close center hydraulic circuit for providing hydraulic fluid to low flow functions.

2. Description of the Prior Art

Work vehicles, such as four wheel drive articulated loaders use hydraulic circuits to control or augment a number of functions, such as steering, loading, braking, controlling, etc. Deere & Company, the assignee of the present application, manufactures a series of four wheel drive articulated loaders. Deere loader models 444D, 544D and 644D are provided with two separate hydraulic circuits, each circuit is pressurized by fixed displacement engine driven gear pump. The first circuit provides hydraulic fluid to the braking functions whereas the second circuit provides hydraulic fluid to the steering and loading functions. The largest loader manufactured by Deere, model 844, has three engine driven fixed displacement vane pumps delivering hydraulic fluid to the steering and loading functions, and a separate engine driven gear pump providing fluid to the braking functions.

Fixed displacement pumps are used in open center hydraulic circuits. Fixed displacement pumps drive the same volume of fluid every cycle, and as such, fluid pressure varies with demand. Variable displacement pumps are used in close center hydraulic circuits. Variable displacement pumps maintain constant output pressure by varying fluid volume output of the pump. Typically fixed displacement pumps are less expensive than similarly sized variable displacement pumps. In addition, open center hydraulic circuits have a quicker response rate because of the constant flow of fluid.

Open center hydraulic systems are generally simpliest and least expensive to design. However, as more hydraulic functions are added, with varying demands on each function, the open center system requires the use of flow dividers to proportion oil flow between the functions. The use of flow dividers in an open center system reduces efficiency with resulting heat buildup.

Close center hydraulic systems with variable displacement pumps are better suited to more complex hydraulic systems because the quantity of oil delivered to each function can be controlled by line size, valve size or by orifice size with less heat buildup when compared to the flow dividers used in comparable open center systems. In addition, closed center systems do not need relief valves, thus, preventing heat buildup where relief pressure is frequently reached.

A number of attempts have been made to use a fixed displacement pump and a variable displacement pump in a hydraulic system to take advantage of each pump's best features. Fixed displacement pumps have been used as charge pumps for variable displacement pumps, see U.S. Pat. Nos. 3,659,419 and 3,785,157. In U.S. Pat. No. 3,659,419 the booster pump prevents cavitation at the suction side of the variable displacement pump while also providing a driving source for other elements. In U.S. Pat. No. 3,859,790 it has been proposed to use a variable displacement pump to drive a public works machine and a fixed displacement pump to drive the jacks actuating the working equipment of the machine.

It has further been proposed, to combine the hydraulic output of both a fixed displacement pump and a variable displacement pump to pressurize the working circuits of a loader backhoe, see U.S. Pat. No. 3,962,870.

SUMMARY OF THE INVENTION

The hydraulic system of the present invention comprises a fixed displacement pump pressurizing an open center hydraulic system and a variable displacement pump pressurizing a close center hydraulic system. Both the pumps are coupled to a common sump through a common suction line. The common suction line acting to prime the variable displacement pump by the fluid being drawn to the fixed displacement pump.

The hydraulic output of the open center pump is directed to a priority valve for dividing the hydraulic flow between the steering circuits and the working circuits. The priority valve favors the steering circuits. The hydraulic output of the variable displacement pump is split between a braking system and a pressure reduction system. The braking system is provided with a separate front brake hydraulic circuit and rear brake hydraulic circuit. Each braking circuit is provided with an independent accumulator, regulating valve and brake actuators. Each regulating valve is manually shiftable with a pilot override. The pilot override is coupled to the hydraulic circuit of the other brake circuit. Therefore, when the brakes are triggered by depressing the pedal of the front regulating valve, the rear regulating valve is also triggered by the hydraulic piloting feature. The pilot feature maintains equal pressure simultaneously in both circuits.

The pressure reduction system comprises three three-way, two-position solenoid actuated valves that are used to control various functions. The pressure reduction system is also provided with a pressure reducing valve through which hydraulic fluid passes to the pilot control system.

The first three-way, two-position valve is used for coupling the pilot control system through the pressure reducing valve to an alternate source of hydraulic pressure. More specifically, the first valve is fluidically coupled to the pressurized boom circuit which is used for supplying hydraulic fluid to the pilot control system for lowering the boom. The first valve is electrically coupled to the ignition switch and oil pressure switch for triggering the first valve when the key is in the ignition switch and the engine is not running.

The second and third three-way, two-position valves fluidically couple the hydraulic fluid to the clutch cut-off and differential lock in response to electrical signals.

The pilot control system is used for positioning the valves used in the working circuit. The pilot control system comprises three pairs of two-position valves that are used for shifting the three working circuit valve spools.

It is the main object of the present invention to provide a hydraulic system for a work vehicle that provides improved hydraulic performance while also being cost efficient.

It is an object of the present invention to provide a hydraulic system that has the advantages of both a close center system and an open center system for different hydraulic functions.

It is an object of the present invention to provide a hydraulic system for a work vehicle wherein the steering and working functions of the vehicle are provided with hydraulic fluid by a fixed displacement pump, and the braking, controlling, and other hydraulic functions are provided with hydraulic fluid by a variable displacement pump.

It is the object of the present invention to provide an alternate hydraulic supply system for the pilot control system for lowering the boom of a work vehicle.

It is the object of the present invention to provide a hydraulic system for a two pedal brake system in which both brake circuits are hydraulically actuated simultaneously, yet the brake circuits are independent of one another so that failure of any one component in one circuit will not render the other circuit unworkable.

It is the object of the present invention to provide a compact hydraulic pressure reduction system which is located in a single valve housing.

These and other objects of the present invention will become apparent in reviewing the drawings in light of the detailed description below.

BRIEF DESCRIPTION OF THE DRAWINGS

FIG. 1 is a side view of a four wheel drive articulated loader.

FIG. 3 is an electrical and hydraulic schematic of the alternate hydraulic fluid supply system of the present invention.

DETAILED DESCRIPTION

Loader

Figure 2A:
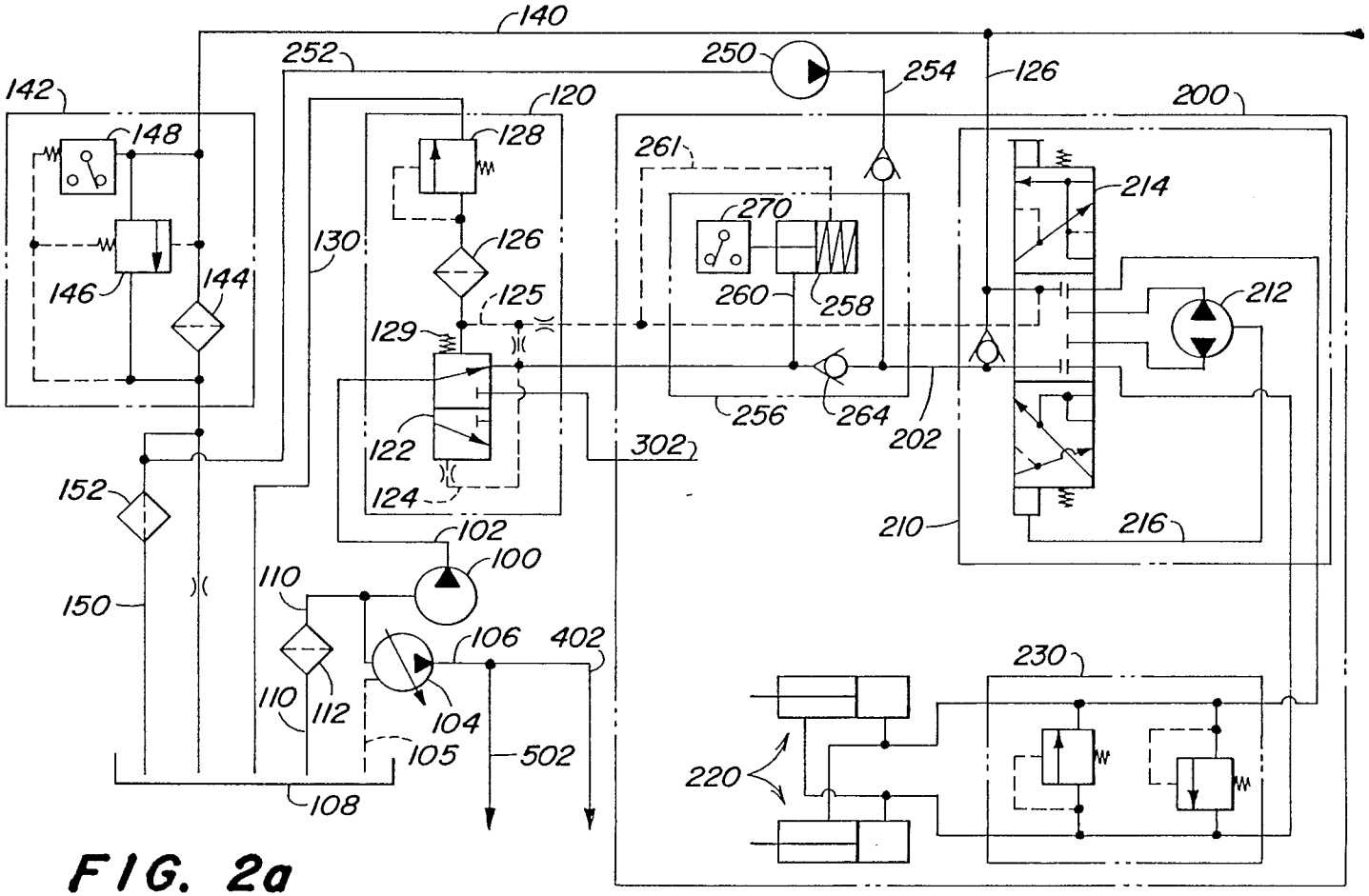
FIGS. 2A–2C are hydraulic schematics of the present invention.

The loader illustrated in FIG. 1 is a four-wheel drive articulated loader. Loader 10 comprises a supporting structure 12 and ground engaging wheels 14. The front of the loader is provided with a movable boom assembly 16 at the end of which is pivotally mounted bucket 18. The boom is lifted by extending boom-lift hydraulic actuator 20, and the bucket is pivoted by bucket-tilt hydraulic actuator 22.

The loader is articulated about vertical pivots 24 and 26 by a hydraulic steering circuit schematically illustrated in FIG. 2. The loader is driven an by internal combustion engine that is housed in engine compartment 30. The internal combustion engine also drives hydraulic pumps for driving the working circuits of the loader and other hydraulically actuated systems. The operator controls the operation of the loader from cab 32.

Hydraulic System Overview

Figure 2B:
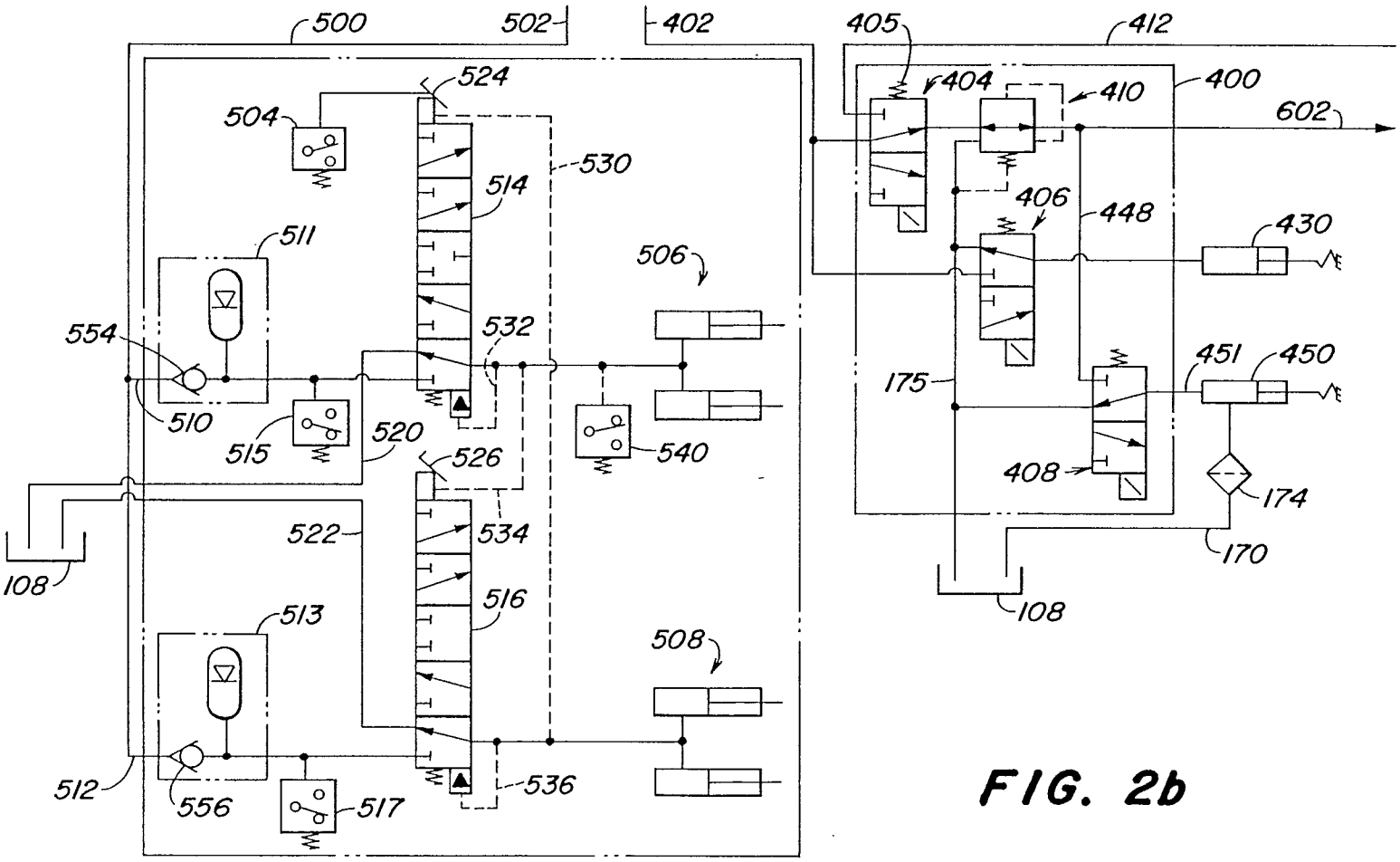
Figure 2C:
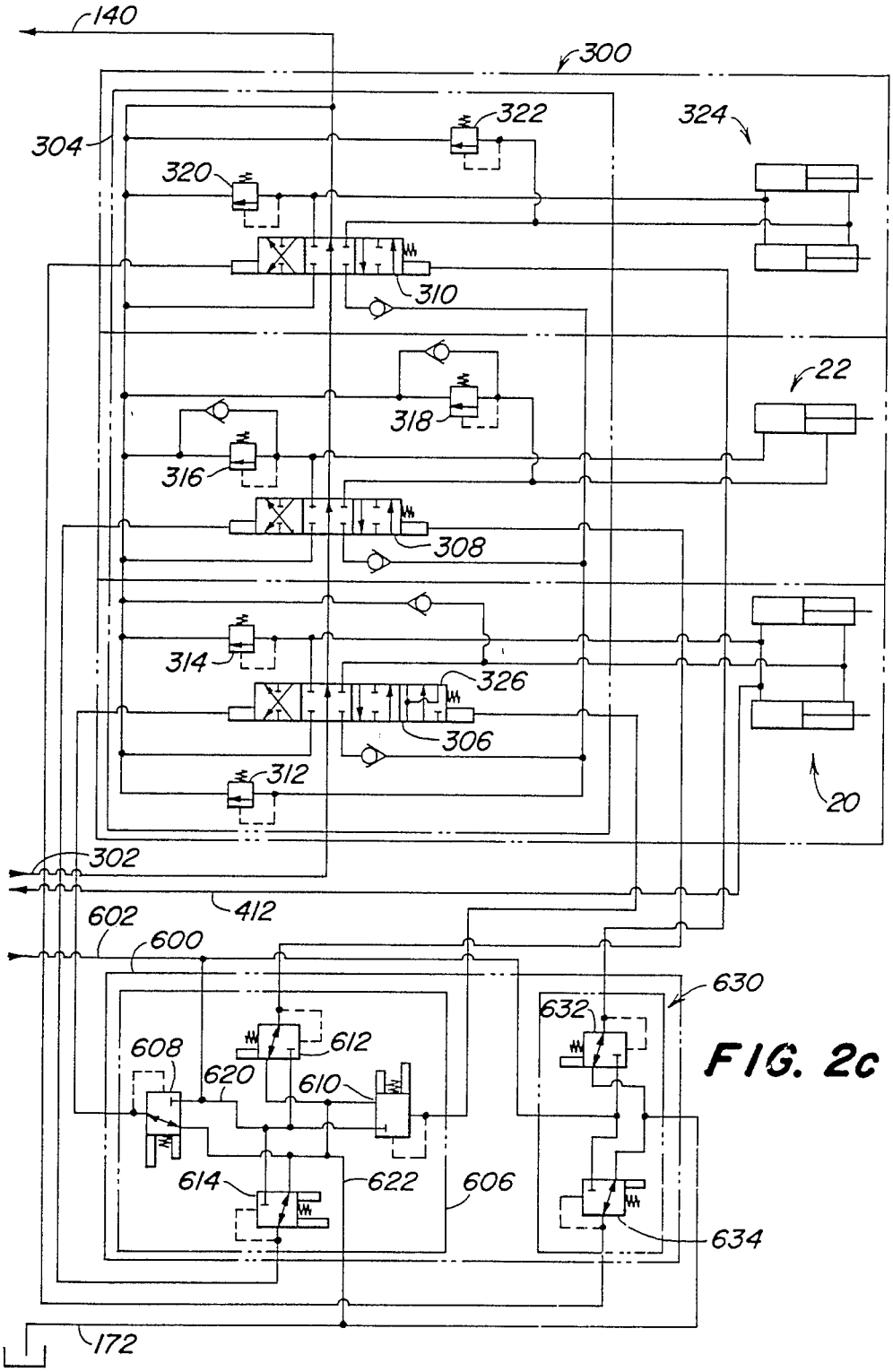

The overall hydraulic system is illustrated schematically in FIGS. 2A–2C, and comprises an open center hydraulic system and a close center hydraulic system. The open center hydraulic system is provided with hydraulic fluid by fixed displacement pump 100 which pumps hydraulic fluid through hydraulic line 102. The close center hydraulic system is provided with hydraulic fluid by variable displacement pump 104 which is provided with a pressure sensing and compensating assembly for maintaining constant pressure in hydraulic line 106. Pump 104 is also provided with drain path 105 for returning leaking hydraulic fluid back to the sump. Both pumps are operatively interconnected in a piggybacked fashion to provide a compact pumping unit. The pumps are driven by the internal combustion engine through a suitable mechanical coupling.

The pumps draw hydraulic fluid from common sump 108 through a common hydraulic fluid suction line 110. Line 110 is provided with a screen 112 for removing large particulates from the hydraulic fluid being directed to pumps 100 and 104. By utilizing a common sump and suction line, the overall cost of the system is reduced. This is especially true in that pump 104 would typically need a charge pump to prime it, and pump 100 can now take over this operation in addition to supplying pressurized fluid to other assemblies on the loader.

The hydraulic fluid output of pump 100 is directed through line 102 to priority valve assembly 120 which prioritizes fluid flow between steering assembly 200 (FIG. 2A) and loader assembly 300 (FIG. 2C). The priority valve assembly gives priority to the steering assembly, shutting off hydraulic fluid flow to the loader assembly in response to fluid demands of the steering assembly. The priority valve assembly comprises a spring biased two-position spool 122 that selectively directs fluid between the steering and loader assemblies. Spool 122 is hydraulically balanced between restricted hydraulic pressure sensing lines 124 and 125. When steering valve 210 is centered in a neutral position, hydraulic flow from supply line 202 through valve 210 is stopped, increasing hydraulic pressure in line 202 and sensing line 124. In the centered position, valve 210 couples sensing line 125 to sump return line 140 through line 126 reducing hydraulic pressure in sensing line 125. As such, the increased hydraulic pressure in line 124 overcomes the hydraulic pressure in line 125 and the biasing force of spring 129 to position spool 122 so that it can transmit hydraulic fluid to loader assembly supply line 302.

The priority valve assembly is also provided with a filter 126 and pressure relief valve 128 through which hydraulic fluid can be directed to sump return line 130. The sump return line receives hydraulic fluid from sensing line 125.

Hydraulic fluid exhausted from steering assembly 200 and loader assembly 300 is directed by sump return line 140 to sump 108. Sump return line 140 is provided with a return filter assembly 142 having filter 144, hydraulically balanced pressure relief valve 146 and hydraulically balanced pressure sensitive electrical switch 148. Hydraulic fluid is typically filtered by the filter and returned to sump 108. However, as the filter collects foreign material, the hydraulic pressure drop across the filter increases closing electrical switch 148. Upon the closing of electrical switch 148, an indicator light is triggered in the operator cab of the loader, alerting the operator that filter 144 should be cleaned or replaced. As the pressure drop continues to increase because of additional foreign material collected on the filter, pressure relief valve 146 opens thereby providing a hydraulic flow path that bypasses the filter.

Hydraulic fluid sump return line 150 located downstream of the filter assembly is provided with oil cooler 152 for cooling oil being returned to sump 108.

The hydraulic fluid output of pump 104 is directed to hydraulic pressure reduction assembly 400 (FIG. 2B) through hydraulic fluid supply line 402; and to brake assembly 500 (FIG. 2B) through hydraulic fluid supply line 502. Hydraulic fluid having a reduced pressure is directed from pressure reduction assembly 400 to pilot control assembly 600 (FIG. 2E), and to differential lock 450 through supply line 451. Hydraulic fluid is returned from differential lock 450 to sump 108 through sump return line 170, and from pilot control assembly 600 to sump 108 through sump return line 172. Sump return line 170 is provided with screen 174 for filtering out large particulates from the return path.

Clutch cutoff 430 is hydraulically coupled to hydraulic line 402 by valve 406. Hydraulic supply return line 481 directs fluid to and from the clutch cutoff.

Hydraulic fluid return line 175 is used for hydraulically venting the expansion sides of the clutch cutoff hydraulic actuator and the differential lock hydraulic actuator. In addition, pressure reduction valve 480 is hydraulically coupled to sump through line 175.

Steering Circuit

Steering assembly 200 receives hydraulic fluid through hydraulic line 202 from priority valve assembly 120. The hydraulic fluid is directed to infinitely variable steering control valve 210. Control valve 210 comprises fluid meter 212 and valve structure 214 which are operatively coupled to one another by mechanical follow up connection 216. Valve structure 214 comprises a main fluid path and a dampening fluid path. The dampening fluid path comprises a number of restricted passages that are used to dampen pressure spikes in the main fluid path. The steering control valve is more fully explained in U.S. patent application Ser. No. 037,493, filed Apr. 13, 1987, in which the present inventor is one of the joint inventors therein, and which is incorporated herein by reference.

The main fluid path directs hydraulic fluid to steering hydraulic cylinders 220 for assisting in steering the loader. Crossover relief valves 230 are located between control valve 210 and hydraulic cylinders 220 for providing pressure relief for the system.

The steering assembly is also provided with an optional secondary steering pump 250 which draws hydraulic fluid from sump return line 150 through hydraulic line 252 and directs the hydraulic fluid to hydraulic fluid supply line 202 by way of hydraulic line 254. The secondary pump is electrically driven and provides back up hydraulic pressure when pump 100 is not functioning. Secondary steering pump control valve 256 is used to actuate the pump. The valve comprises a hydraulically balanced spring biased piston 258 that is hydraulically balanced between sensing line 125 and supply line 202. Hydraulic sensing line 260 of control valve 256 is fluidically coupled to supply line 202 upstream of check valve 264. Hydraulic sensing line 261 of control valve 256 is fluidically coupled to sensing line 125. The piston is coupled to electrical switch 270 which when closed actuates electrical pump 250. Switch 270 is closed when the hydraulic pressure in sensing line 125 exceeds or equals the hydraulic pressure in line 260 indicating pump 100 has failed.

Working Circuit

Hydraulic fluid is directed to the working circuit through hydraulic line 302. The loader circuit comprises loader control valve 304 having three pilot controlled directional control spools 306, 308 and 310 with associated pressure relief valves 312, 314, 316, 318 320 and 322. The directional control spools control the movement of the three hydraulic actuators, which include boom-lift actuator 20, bucket-tilt actuator 22, and auxiliary actuator 324. Hydraulic auxiliary actuator 324 is used to manipulate hydraulically operated accessories, such as a side dump bucket or a clam bucket. All the control spools are positioned by pilot control assembly 600 which will be discussed in more detail below.

Control spools 308 and 310 are four-way three position directional control spools, whereas control spool 306 is of a similar structure, but provided with a fourth position 326 which is used to place boom-lift hydraulic actuator 20 into a float configuration. In the float configuration the weight of the load carried by the boom will lower the boom by coupling both sides of the boom-lift actuator to sump.

Pressure Reducing Circuit

The pressure compensating circuit comprises three two-position solenoid valves 404, 406 and 408. In its supply position, two-position valve 404 directs hydraulic fluid from supply line 402 to pressure reducing valve 410. The pressure reducing valve maintains a constant reduced output pressure in pilot control supply line 602. Valve 404 is a spring biased solenoid actuated valve which is positioned into its supply position by the biasing force of spring 405, thereby normally directing hydraulic fluid from pump 104 to the pilot control system.

In its second position valve 404 checks the flow of hydraulic fluid from pump 104 to pressure reducing valve 410. However, valve 404 is only in its second position when the loader is switched on and engine oil pressure has fallen below a certain level indicating the engine has stopped. To maintain hydraulic pressure in the pilot control system for a limited period of time, valve 404 is provided with supply line 412 that is coupled to the extension side of boom-lift actuator 20. Therefore, when valve 404 is in its second position hydraulic pressure is directed from boom-lift actuator 20 through line 412 to pressure reducing valve 410. In this way, the extended boom-lift actuator acts as a pressure accumulator for the pilot control system.

The operation of valve 404 is best illustrated in FIG. 3, valve 404 is normally positioned into its first supply position by spring 409. Solenoid 407 is electrically connected to battery 420 through accessory relay 421. Accessory relay 421 is energized by the ignition key being switched on in the ignition closing key switch 422. When the accessory relay is energized, switch 423 is closed forming an electrical path between the battery and the solenoid. Solenoid 407 is also coupled to ground through oil pressure switch relay 424. Relay 424 is electrically coupled between the output of accessory relay 421 and engine oil pressure switch 425. The engine oil pressure switch closes in response to oil pressure in the engine falling below a certain level. The triggering oil pressure level is the oil pressure level at which the engine is not running. When switch 425 closes, relay 424 is energized closing switch 426 and forming an electrical path between solenoid 407 and ground. When both relay 421 and relay 424 are closed solenoid 407 is energized and valve 404 shifted into its second position. Ignition switch 422 and oil pressure switch 425 for operating condition sensors that sense selected operating conditions of the engine. These operating conditions are whether the engine is turned on (ignition switch) and whether the engine is running (engine oil switch). Together with relays 421 and 424, these sensors form a means for automatically shifting valve 404 from its first supply position to its second position in response to an operating condition signal from both of these sensors.

The pressure reducing circuit is provided with clutch cut off valve 406 for directing hydraulic to and from clutch cutoff actuator 430 of the drive transmission. The clutch cutoff decouples the engine output from the drive wheel so that the engine is no longer driving the wheels. Valve 406 is a solenoid actuated valve that is electrically coupled to clutch cutoff switch 504. Switch 504 is operatively associated with the braking system of the loader. Normally, valve 406 directly couples the cut off actuator to sump and the transmission is engaged with the engine, however, when the clutch cutoff switch is actuated by the left brake pedal, hydraulic fluid supply line 402 is fluidically coupled to clutch cutoff actuator 430, thereby disengaging the engine from the drive transmission.

Differential lock valve 408 is also a solenoid actuated valve that is actuated, by the operator of the loader depressing a switch. Valve 408 is used to fluidically couple the pressure reduced hydraulic output of pressure reducing valve 410 through supply line 448 to differential lock actuator 450. The differential lock actuator locks the differential upon demand of the operator to provide additional traction for the loader.

A big advantage of pressure reducing valve assembly 400 is that a single valve houses several related valve functions. As such, this assembly reduces the number of valve housings and the amount of hydraulic lines required, resulting in a cost savings because of this simple installation.

Brake System

Both the front wheels and the rear wheels are provided with hydraulic brakes that are actuated by hydraulic actuators 506 and 508, respectively. Hydraulic fluid is directed to the brakes from supply line 502 by parallel hydraulic lines 510 and 512. Both parallel lines have hydraulic accumulators 511 and 513 for storing hydraulic pressure when the loader is switched off. Hydraulic fluid is directed through five position valves 514 and 516 to the hydraulic actuators. Lines 510 and 512 are also provided with hydraulic pressure sensing electrical switches 515 and 517 that are electrically coupled to lights on the operator's console to indicate sufficient pressure in the individual braking circuits. Hydraulic fluid is returned to sump 108 from the brake actuators through lines 520 and 522.

The operator's station is provided with two brake pedals 524 and 526. Each pedal is able to actuate all of the brakes. Pedal 524 is also provided with clutch cutoff switch 504 which is used to shift clutch cutoff valve 406 and actuate clutch cutoff actuator 430. Therefore, depressing pedal 524 not only triggers the brakes, but also the clutch cutoff; whereas depressing pedal 526 only triggers the brakes.

Although the brake valves are manually movable by depressing the brake pedals that are also hydraulically shiftable. Brake valve 514 is hydraulically balanced between hydraulic sensing lines 530 and 532. Sensing line 530 is coupled to the output line of brake valve 516; whereas sensing line 532 is coupled to the output line of brake valve 514. In this way, as brake valve 516 is manually depressed by the operator brake valve 514 is hydraulically depressed by the increase in hydraulic pressure in line 530. Similarly brake valve 516 is hydraulically balanced between hydraulic sensing lines 534 and 536. When brake valve 514 is manually depressed by the operator, brake valve 516 is hydraulically depressed by the increase in hydraulic pressure in line 534.

Hydraulic pressure accumulators 511 and 513 are provided with check valves 554 and 556. These check valves hydraulically isolate the front braking circuit from the rear braking circuit. In this way, if a component in one of the circuits fails, the other will not be effected.

Hydraulic pressure sensing switch 540 is fluidically coupled to the output of brake valve 514 to light brake indicator lights located on the exterior of the vehicle.

Pilot Control System

The pilot control system comprises two valve packages that hydraulically control the positioning of loader control spools 306, 308 and 310. The control system provides hydraulic inputs to the sides of the valve spools for hydraulically shifting the spools. Hydraulic fluid from the pressure reduction system is directed to the pilot control system through line 602 and hydraulic fluid is returned to sump 108 through sump return line 172.

First valve package 606 is provided with four two-position valve spools 608, 610, 612 and 614 that are arranged in two opposed pairs. The first opposed pair 608 and 610 control the positioning of boom-lift spool 306, whereas the second opposed pair 612 and 614 control the positioning of bucket-tilt spool 308. Fluid from line 602 is directed to shared hydraulic supply line 620 to which each of the four valves is fluidically coupled. In addition, each of the four valves is fluidically coupled to shared sump return line 622 that is in fluid communication with sump return line 172.

The positioning of the four valves is manually controlled by the operator through a joystick arrangement. As the joystick is moved backward, valve spool 608 is positioned to direct hydraulic fluid from shared hydraulic line 620 to the left side of valve spool 306. At the same time, valve spool 610 fluidically couples the right side of valve spool 306 to shared sump line 622. In this way, valve spool 306 is moved to the right so that hydraulic fluid from supply line 302 extends boom-lift actuator 20 raising the boom. The bucket-tilt actuator is controlled in a similar manner, by the left and right movement of the joystick controller.

Second valve package 630 is provided with a single pair of two position valves 632 and 634 that are manipulated by a separate control lever. The second valve package is used for controlling the positioning of control spool 310. Spool 310 controls the flow of hydraulic fluid to hydraulic actuator 324. Therefore, by manipulating valve package 630, the extension and retraction of hydraulic actuator 324 is controlled by the operator.

The hydraulic system described above is well suited to a work vehicle. The system provides relatively rapid responding steering and work circuits, and control functions to which is applied hydraulic fluid having a constant pressure.

The present invention should not be limited by the above described embodiment, but should be limited solely by the claims that follow.

We claim:

1. A pilot control system for a work vehicle having a supporting structure, ground engaging means for propelling the vehicle, a working hydraulic actuator for performing a work operation and working hydraulic control valves for controlling the movement of the working hydraulic actuator, the pilot control system comprising:

a pilot control valve for controlling the positioning of a working hydraulic control valve;

a main source of hydraulic fluid for supplying pressurized hydraulic fluid to the pilot control valve;

a prime mover for driving the main source of hydraulic fluid; the prime mover is provided with an ignition switch and an operating condition sensor for sensing an operating condition of the prime mover;

an alternate source of hydraulic fluid for supplying hydraulic fluid to the pilot control valve spools;

a control valve alternatively fluidically couples the main source and the alternate source of hydraulic fluid to the pilot control valve spools, the control valve is a solenoid valve that has a first supply position for fluidically coupling the main source of hydraulic fluid to the pilot control valve spools, and a second position for fluidically coupling the alternate source of hydraulic fluid to the pilot control valve spools; the control valve is operatively coupled to the ignition switch and the operating condition sensor of the prime mover so that when the ignition switch of the prime mover is actuated and the operating condition sensor is triggered, the control valve is shifted into its second position.

2. A pilot control system as defined by claim 1 wherein the control valve comprises a solenoid valve and is provided with a spring for biasing the control valve into the first supply position.

3. A pilot control system as defined by claim 2 wherein the operating condition sensor comprises an oil pressure switch operatively associated with the prime mover which is triggered when oil pressure in the prime mover has fallen below a level indicating the prime mover has stopped.

4. A pilot control system as defined by claim 3 wherein the alternate source of hydraulic fluid is the working hydraulic actuator.

5. A pilot control system as defined by claim 4 wherein the vehicle is provided with a movable boom which is operatively positioned by a boom actuator which comprises the working actuator which is the alternate source of hydraulic fluid.

6. A pilot control system as defined by claim 5 wherein the main source of hydraulic fluid is a variable displacement pump.

7. A pilot control system as defined by claim 6 wherein a pressure reducing valve is fluidically positioned between the variable displacement pump and the pilot control valve.

8. A pilot control system for a work vehicle having a supporting structure, ground engaging means for propelling the vehicle, a working hydraulic actuator for performing a work operation and working hydraulic control valves for controlling the movement of the working hydraulic actuator, the pilot control system comprising:

a pilot control valve for controlling the positioning of a working hydraulic control valve;

a main source of hydraulic fluid for supplying pressurized hydraulic fluid to the pilot control valve;

a prime mover for driving the main source of hydraulic fluid;

the working hydraulic actuator comprises an alternate source of pressurized hydraulic fluid for supplying hydraulic fluid to the pilot control valve;

a control valve alternatively fluidically couples the main source and the alternate source of hydraulic fluid to the pilot control valve, the control valve has a first supply position for fluidically coupling the main source of hydraulic fluid to the pilot control valve, and a second position for fluidically coupling the alternate source of hydraulic fluid to the pilot control valve.

9. A pilot control system as defined by claim 8 wherein the vehicle is provided with a movable boom which is operatively positioned by a boom actuator which comprises a working actuator which is the alternate source of hydraulic fluid.

10. A pilot control system as defined by claim 9 wherein the control valve is fluidically coupled to the extension side of the boom actuator.

11. A pilot control system for a work vehicle having a supporting structure, ground engaging means for propelling the vehicle, a working hydraulic actuator for performing a work operation and working hydraulic control valves for controlling the movement of the working hydraulic actuator, the pilot control system comprising:

a pilot control valve for controlling the positioning of a working hydraulic control valve;

a main source of hydraulic fluid for supplying pressurized hydraulic fluid to the pilot control valve;

a prime mover for driving the main source of hydraulic fluid, the prime mover being provided with an operating condition sensor for sensing an operating condition of the prime mover;

an alternate source of hydraulic fluid for supplying hydraulic fluid to the pilot control valve;

a control valve alternatively fluidically couples the main source and the alternate source of hydraulic fluid to the pilot control valve, the control valve has a first supply position for fluidically coupling the main source of hydraulic fluid to the pilot control valve, and a second position for fluidically coupling the alternate source of hydraulic fluid to the pilot control valve; and means for automatically shifting the control valve from the first supply position to the second position in response to an operating condition signal from the operating condition sensor.

* * * * *